US009357824B2

(12) United States Patent
McDonald et al.

(10) Patent No.: US 9,357,824 B2
(45) Date of Patent: Jun. 7, 2016

(54) BAG WITH ENCLOSED INFLATABLE DEVICE

(71) Applicants: Wayne Mitchell McDonald, Bluffton, SC (US); Colton Sands McDonald, Bluffton, SC (US); Joseph Ridge McDonald, John's Island, SC (US); Suzanna Rose McDonald, New York, NY (US)

(72) Inventors: Wayne Mitchell McDonald, Bluffton, SC (US); Colton Sands McDonald, Bluffton, SC (US); Joseph Ridge McDonald, John's Island, SC (US); Suzanna Rose McDonald, New York, NY (US)

(73) Assignee: Globepac, LLC, Hilton Head Island, SC (US)

( * ) Notice: Subject to any disclaimer, the term of this patent is extended or adjusted under 35 U.S.C. 154(b) by 130 days.

(21) Appl. No.: 14/059,098

(22) Filed: Oct. 21, 2013

(65) Prior Publication Data

US 2015/0107949 A1 Apr. 23, 2015

(51) Int. Cl.

| | |
|---|---|
| ***A45C 9/00*** | (2006.01) |
| ***A45C 15/00*** | (2006.01) |
| ***A45C 5/14*** | (2006.01) |
| ***A45C 13/26*** | (2006.01) |
| ***A47C 17/82*** | (2006.01) |
| ***A47C 27/08*** | (2006.01) |
| ***A47C 1/14*** | (2006.01) |
| ***A47C 4/54*** | (2006.01) |
| ***A47C 15/00*** | (2006.01) |

(52) U.S. Cl.

CPC . *A45C 15/00* (2013.01); *A45C 5/14* (2013.01); *A45C 9/00* (2013.01); *A45C 13/262* (2013.01); *A47C 1/146* (2013.01); *A47C 4/54* (2013.01); *A47C 15/006* (2013.01); *A47C 17/82* (2013.01); *A47C 27/081* (2013.01); *A45C 2009/002* (2013.01); *A45C 2013/267* (2013.01)

(58) Field of Classification Search

CPC .... A45C 7/004; A45C 13/262; A45C 7/0081; A45C 9/00; A45C 13/28; A47C 17/82

USPC ..... 190/2, 112; 383/3

See application file for complete search history.

(56) References Cited

U.S. PATENT DOCUMENTS

| | | | | |
|---|---|---|---|---|
| 3,818,962 | A | 6/1974 | Muller-Scherak | |
| 4,044,867 | A * | 8/1977 | Fisher | 190/107 |
| 4,573,202 | A * | 2/1986 | Lee | 383/3 |
| 4,723,300 | A | 2/1988 | Aranow | |
| 4,762,231 | A * | 8/1988 | Kiselewski | B65D 81/052 206/522 |
| 4,999,863 | A | 3/1991 | Kane | |
| 5,370,460 | A | 12/1994 | Nelson | |
| 5,397,000 | A * | 3/1995 | Holte | A45C 13/02 206/522 |
| 5,611,414 | A * | 3/1997 | Walker | 190/2 |
| 5,843,556 | A | 12/1998 | Levas | |

(Continued)

*Primary Examiner* — Sue A Weaver

(74) *Attorney, Agent, or Firm* — Clements Bernard, PLLC; Seth L. Hudson

(57) ABSTRACT

The present invention provides methods and systems for a bag that has a first compartment and a second compartment. The first compartment has a bottom wall that extends to an outer edge and a first pair and second pair of opposed sidewalls that extend generally perpendicularly from the outer edge of the bottom wall forming a cavity therein. A first top wall selectively secured to the first pair and second pair of opposed sidewalls of the first compartment, and a second compartment has a bottom wall that extends to an outer edge and a first pair and second pair of opposed sidewalls that extend generally perpendicularly from the outer edge of the bottom wall forming a cavity therein. A second top wall is selectively secured to the first pair and second pair of opposed sidewalls of the second compartment, and an inflatable device is contained within the second compartment.

12 Claims, 11 Drawing Sheets

(56) References Cited

U.S. PATENT DOCUMENTS

| | | | | |
|---|---|---|---|---|
| 5,934,425 | A * | 8/1999 | Sadow | A45C 13/262 16/408 |
| 7,735,643 | B2 * | 6/2010 | Sanches et al. | 206/315.3 |
| 8,042,662 | B2 * | 10/2011 | Su | 190/115 |
| 8,439,174 | B1 * | 5/2013 | Miranda | 190/2 |
| 2005/0284791 | A1 * | 12/2005 | Sadow | B65D 81/052 206/522 |
| 2006/0207849 | A1 * | 9/2006 | Sadow | 190/18 A |
| 2008/0116026 | A1 | 5/2008 | Bass et al. | |
| 2011/0056788 | A1 | 3/2011 | Jackson | |
| 2012/0085608 | A1 * | 4/2012 | Huang | A45C 13/021 190/124 |
| 2013/0180816 | A1 * | 7/2013 | Wytenhove | A45C 5/03 190/103 |
| 2013/0228600 | A1 * | 9/2013 | Teixeira | 224/156 |
| 2014/0326558 | A1 * | 11/2014 | Marti | 190/2 |

* cited by examiner

Fig. 5
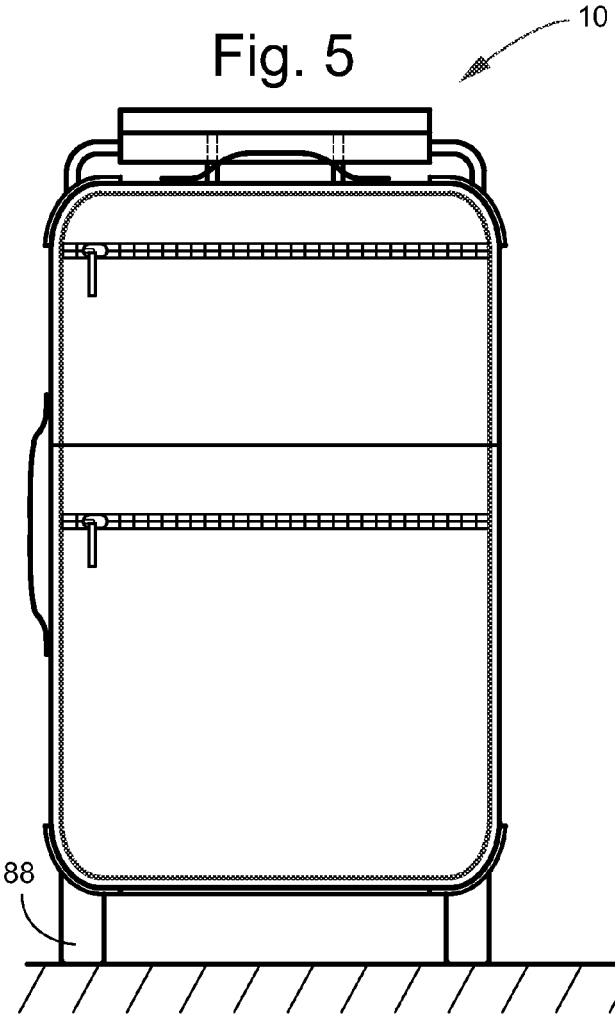
Fig. 6
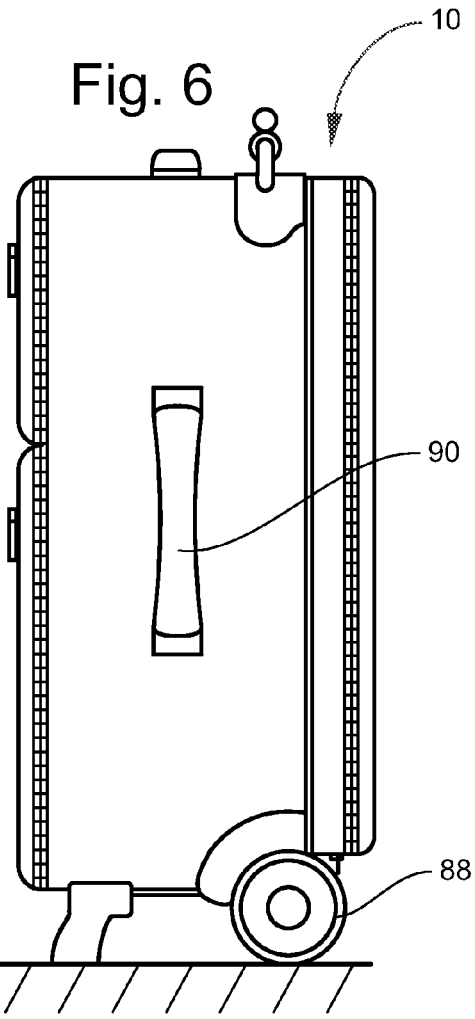
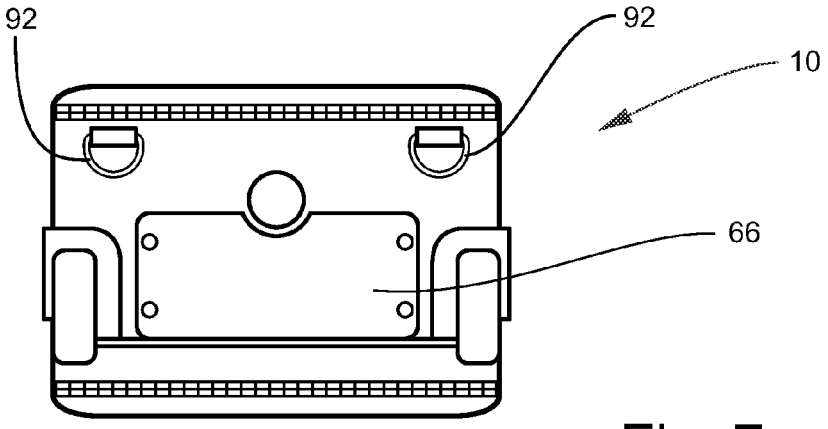
Fig. 7

BAG WITH ENCLOSED INFLATABLE DEVICE

FIELD OF THE INVENTION

The present invention relates generally to a bag, such as a travel bag, that includes an enclosed inflatable device, and more generally relates to a bag that contains an enclosed inflatable device and a self contained inflation device for inflating the inflatable device.

BACKGROUND OF THE INVENTION

The present device can also be used by individuals, such as a traveler, that needs to have a readily available and comfortable place to rest. For example, the weary airline traveler that experiences a longer than expected layover at the airport or even a flight cancellation, can utilize the present device to both carry items and provide a readily available and deployable device providing a comfortable place to rest.

Alternatively, a child visiting their grandparents or going on a family vacation can utilize the bag. The bag contains the child's clothes and toiletries, but also serves as a comfortable place to sleep when the enclosed inflatable device is deployed.

BRIEF SUMMARY OF THE INVENTION

According to an embodiment of the present invention, the present invention is a bag that includes a first compartment and a second compartment, the first compartment has a bottom wall that extends to an outer edge and a first pair and second pair of opposed sidewalls that extend generally perpendicularly from the outer edge of the bottom wall forming a cavity therein. A top wall is selectively secured to the first pair and second pair of opposed sidewalls of the first compartment. An inflatable device is housed within the bag.

According to another embodiment of the present invention, the bag includes a second compartment for housing the inflatable device.

According to yet another embodiment of the present invention, the bag includes a pair of wheels disposed on the bag.

According to yet another embodiment of the present invention, the bag includes a zipper for selectively securing the top wall to the first and second pair of opposed sidewalls.

According to yet another embodiment of the present invention, the bag includes a bag that has a top side, a bottom side, a first side, a second side, a first compartment and a second compartment. The first compartment has a bottom wall that extends to an outer edge and a first pair and a second pair of opposed sidewalls that extend generally perpendicularly from the outer edge of the bottom wall forming a cavity therein. A first top wall selectively secured to the first pair and the second pair of opposed sidewalls of the first compartment, and a second compartment has a bottom wall that extends to an outer edge and a first pair and a second pair of opposed sidewalls that extend generally perpendicularly from the outer edge of the bottom wall forming a cavity therein. A second top wall is selectively secured to the first pair and the second pair of opposed sidewalls of the second compartment, and an inflatable device is contained within the second compartment.

According to yet another embodiment of the present invention, the bag includes a top side, a bottom side, a first side, a second side, a first compartment and a second compartment. The first compartment has a bottom wall that extends to an outer edge and a first pair and a second pair of opposed sidewalls that extend generally perpendicularly from the outer edge of the bottom wall forming a cavity therein. A first top wall selectively secured to the first pair and the second pair of opposed sidewalls of the first compartment, and a second compartment has a bottom wall that extends to an outer edge and a first pair and a second pair of opposed sidewalls that extend generally perpendicularly from the outer edge of the bottom wall forming a cavity therein. A second top wall is selectively secured to the first pair and the second pair of opposed sidewalls of the second compartment. An inflatable device is contained within the second compartment, and a pump is disposed within the bag.

According to yet another embodiment of the present invention, the bag includes a pump including a pair of cylinders with a piston disposed within each cylinder that are movable within the vertical direction, whereby when the pistons are moved toward the bottom side of bag, air is displaced through a nozzle that is releasably engaged to the inflatable device.

According to yet another embodiment of the present invention, the bag includes a rubber and foldable inflatable device.

According to yet another embodiment of the present invention, the bag includes a pair of D-rings engaged to the bag.

BRIEF DESCRIPTION OF THE DRAWINGS

The present invention is illustrated and described herein with reference to the various drawings, in which like reference numbers denote like method steps and/or system components, respectively, and in which:

FIG. 5 is a front view of the bag;

FIG. 6 is a side view of the bag;

FIG. 7 is a bottom view of the bag;

DETAILED DESCRIPTION OF THE INVENTION

Figure 1:
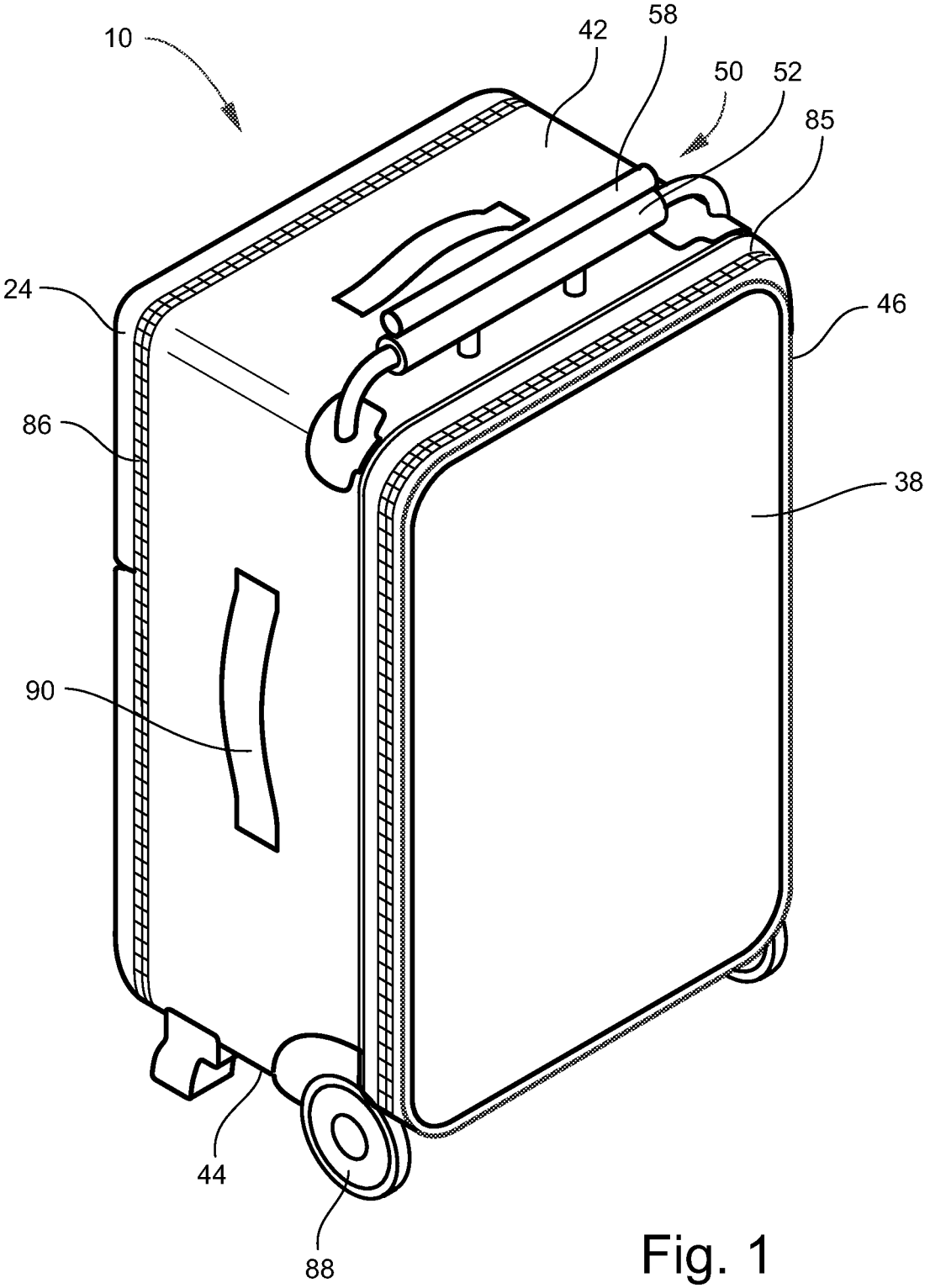
FIG. 1 is a perspective view of the bag.

Referring now specifically to the drawings, a bag device is illustrated in FIGS. 1-16 and is shown generally at reference numeral 10. The device 10 comprises a first compartment 12. The first compartment 12 includes a bottom wall 14 that extends to an outer edge 16 and a first pair of opposed sidewalls 18 and second pair of opposed sidewalls 20 that extend generally perpendicularly from the outer edge 16 of the bottom wall 14 forming a cavity 22 therein. A first top wall 24 is selectively secured to the first pair of opposed sidewalls 18 and the second pair of opposed sidewalls 20 of the first compartment 12.

The bag 10 comprises a second compartment 26. The second compartment 26 includes a bottom wall 28 that extends to an outer edge 30 and a first pair of opposed sidewalls 32 and second pair of opposed sidewalls 34 that extend generally perpendicularly from the outer edge 30 of the bottom wall 28 forming a cavity 36 therein. A second top wall 38 is selectively secured to the first pair of opposed sidewalls 32 and second pair of opposed sidewalls 34 of the second compartment 26.

Figure 4:
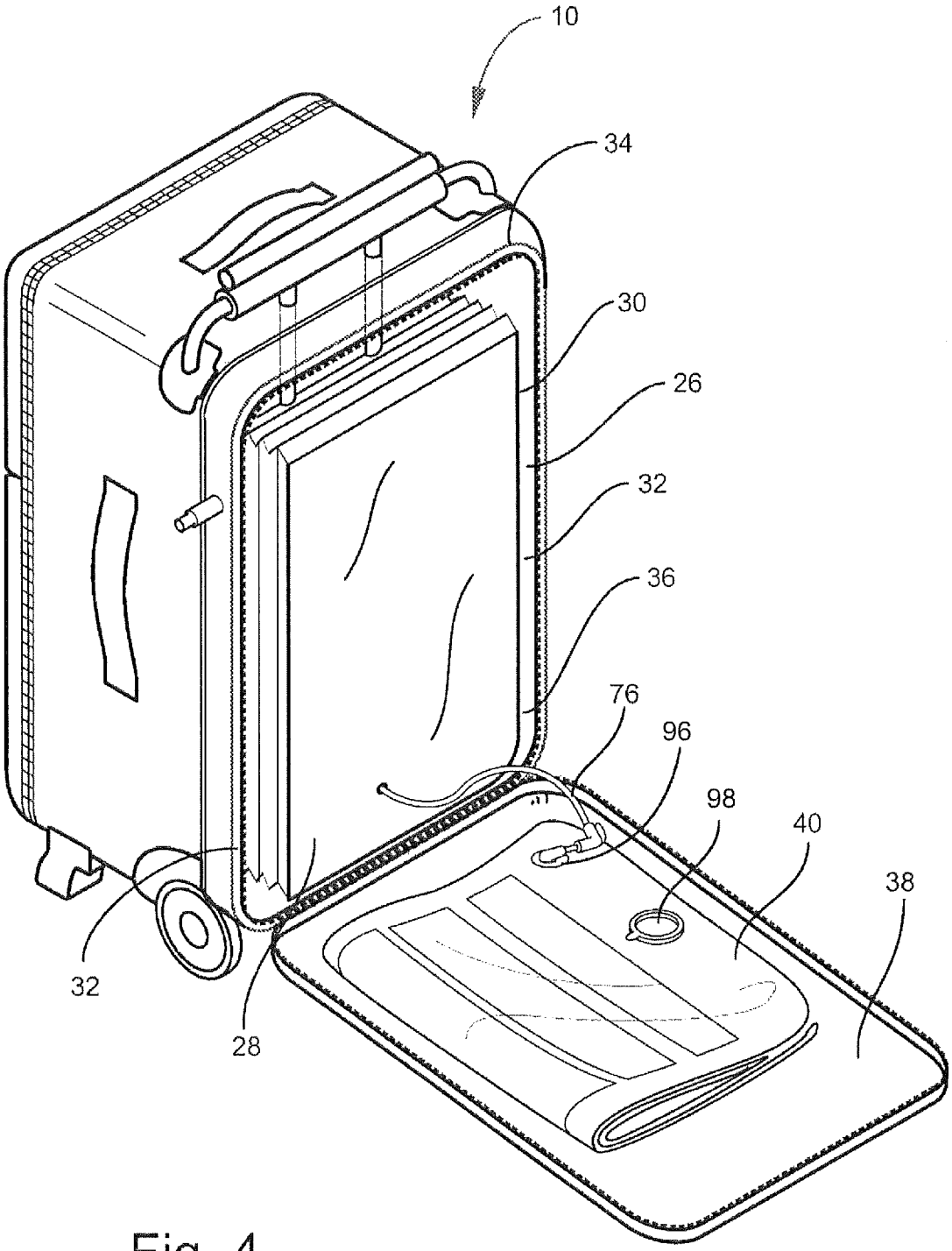
FIG. 4 is a perspective view of the bag and inflatable device.
Figure 8:
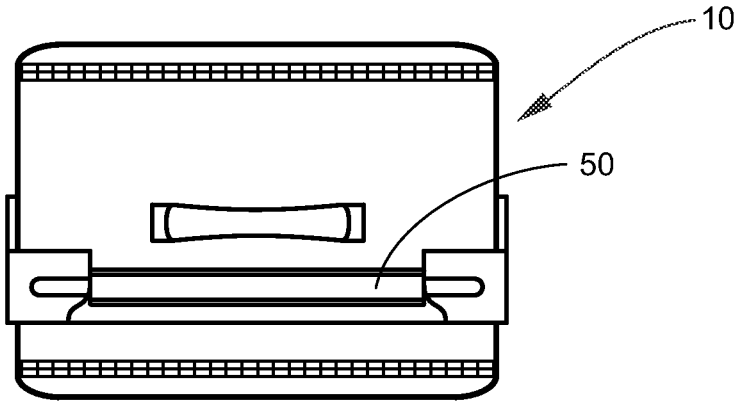
FIG. 8 is a top view of the bag.
Figure 9:
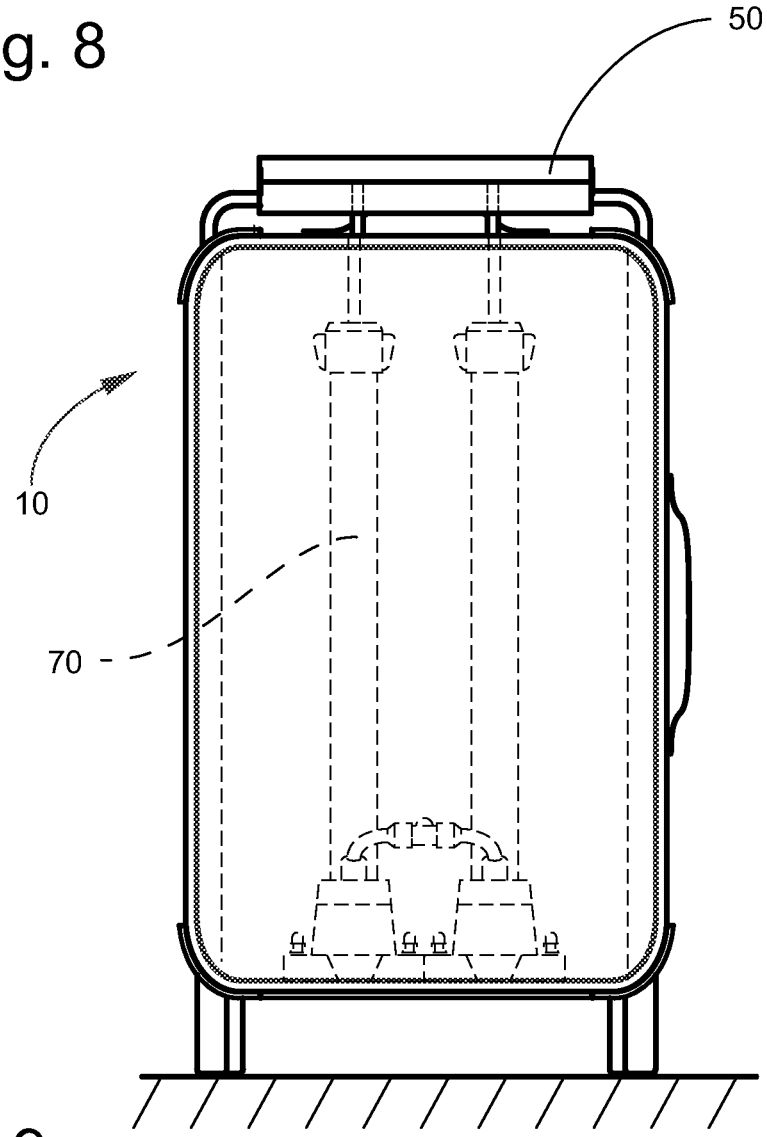
FIG. 9 is a rear view of the bag indicating the pump assembly contained therein.

An inflatable device 40 is contained within the bag. As illustrated in FIG. 4, the inflatable device 40 is housed within the cavity 36 of the second compartment 26. Preferably, the inflatable device 40 is composed of rubber and foldable. The bag 10 has a top side 42, a bottom side 44, a first side 46, and a second side 48. The first pair 18 and second pair 20 of sidewalls of the first compartment are preferably rigid for forming secure and protective sidewalls. The first pair 32 and second pair 34 of sidewalls of the second compartment are preferably rigid for forming secure and protective sidewalls.

Figure 2:
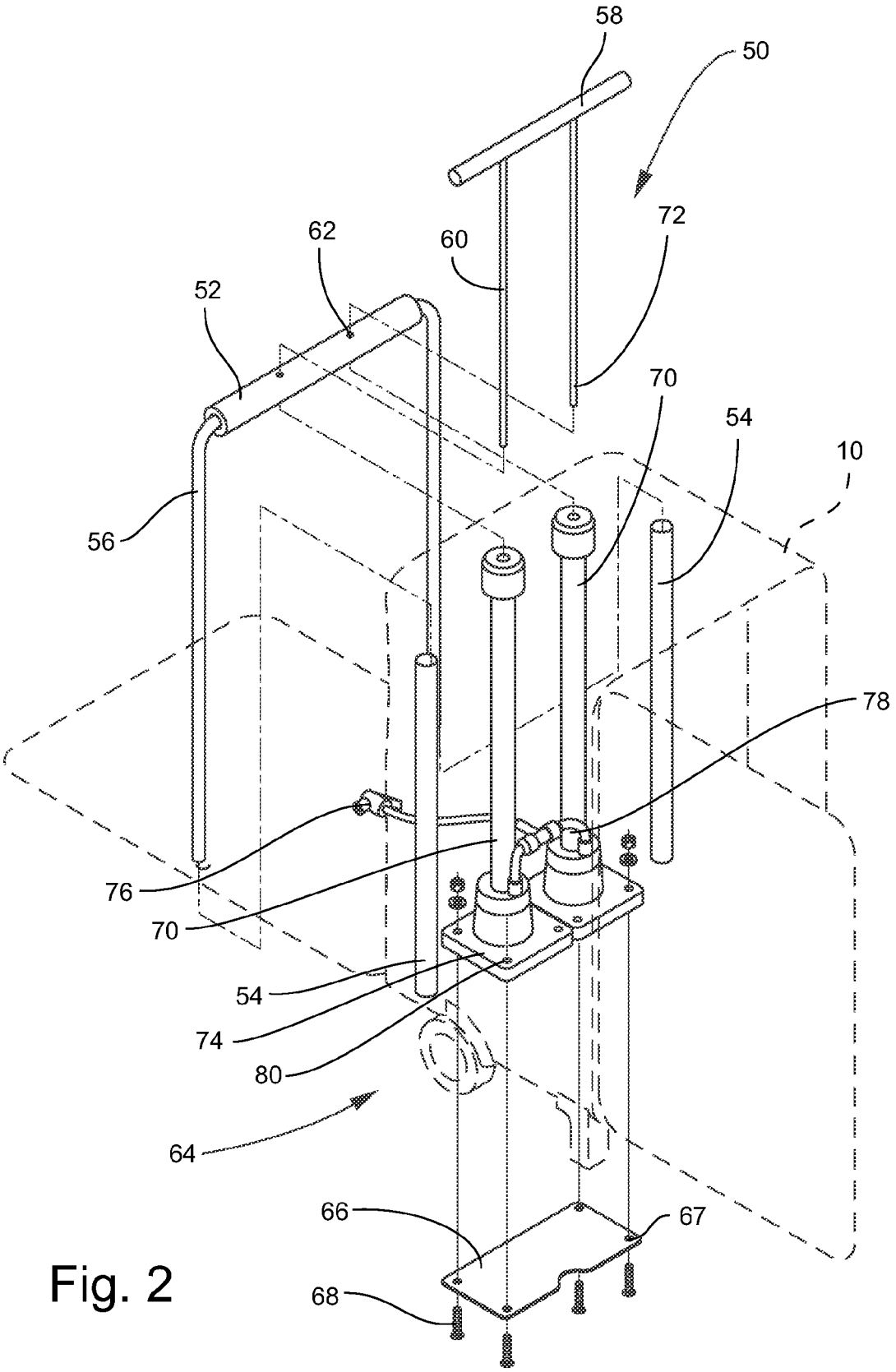
FIG. 2 is an exploded view of the pump assembly and handle assembly disposed within the bag.
Figure 3:
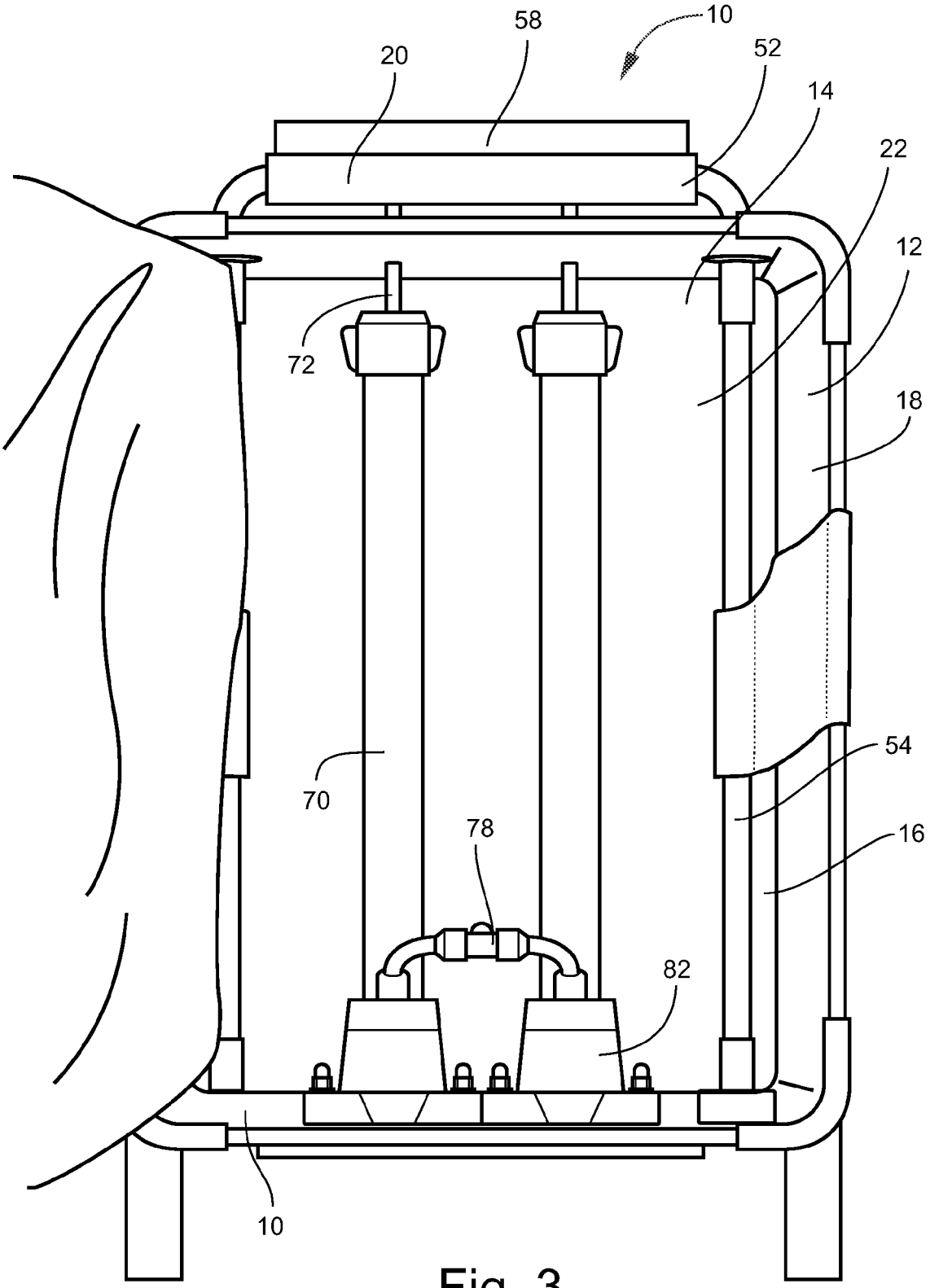
FIG. 3 is an internal view of the pump assembly within the bag.

As illustrated in FIGS. 5 and 6, a handle assembly 50 is disposed on the top side 42 of the bag 10. The handle assembly 50 contains a first horizontal bar 52 that is in a telescopic relationship with the bag 10. As illustrated in FIG. 3, a support member 54 is disposed on the first side 46 and second side 48 of the bag within the cavity 22 of the first compartment 12. The support member 54 is hollow for receiving a vertical portion 56 of the horizontal bar 52 that extends generally downwardly. The vertical portion 56 of the horizontal bar 52 is in a telescopic relationship with the support member 54. The handle assembly 50 also includes a pump handle 58 that is disposed adjacent the horizontal bar 52 and actually rests upon the horizontal bar 52. The pump handle 58 contains at least one downwardly extending member 60 that is received within at least one bore 62 disposed within the horizontal bar 52 of the handle assembly 50. As illustrated in FIG. 2, the pump handle 58 preferably contains two downwardly extending members 60 and the horizontal bar 52 contains two bores 62.

As shown in FIGS. 2 and 3, a pump assembly 64 is disposed within the bag 10. Specifically, the pump assembly 64 is housed within the first compartment 12, as shown in FIG. 3. However, the pump assembly 64 may be housed within the second compartment 26, between the first compartment 12 and the second compartment 26, or disposed external to the bag 10. A support plate 66 is engaged to the bottom side 44 of the bag 10, and as illustrated in FIG. 2, the support plate 66 may be disposed on the external side of the bottom side 44 of the bag 10, or in the alternative, the internal side of the bottom side 44 of the bag 10. The support plate 66 may be secured to the bottom side 44 of the bag with attachment means, such as at least one bolt 68 or the like.

The pump assembly 64 comprises at least one cylinder 70, a piston 72, a support base 74, a nozzle 76, and optionally an air bridge 78. The at least one cylinder 70 is engaged to the support base 74, whereby the support base 74 is engaged to the internal side of the bottom side 44 of the bag 10. The support base 74 is disposed adjacent the support plate 66 and contains spaced apart bores 80 for receiving that at least one bolt 68 of the support plate 66 for providing stability and support. As illustrated in FIG. 2, the support plate 66 is rectangularly shaped with four bores 67 positioned on the four corners of the support plate 66. The support base 74 of the pump assembly 64 contains corresponding bores 80 positioned on the corners of the generally square shaped support base 74 and the bores 80 are placed overtop the bores 67 of the support plate 66 for receiving the bolt 68, forming a selectively secured arrangement.

The support base 74 may contain an air chamber 82 disposed between the support base 74 and cylinder 70. The air chamber 82 contains an opening 84 for allowing air to be released from the pump assembly 64. The nozzle 76 may be connected directly to the opening 84. Alternatively, when two or more cylinders 70 are utilized, as shown in FIG. 2, an air bridge 78 is connected to the opening 84 of each air chamber 82 for collecting the air. The nozzle 76 is engaged to the air bridge 78 for directing the air away from the pump assembly 64 and engagement to the inflatable device 40.

Figure 10:
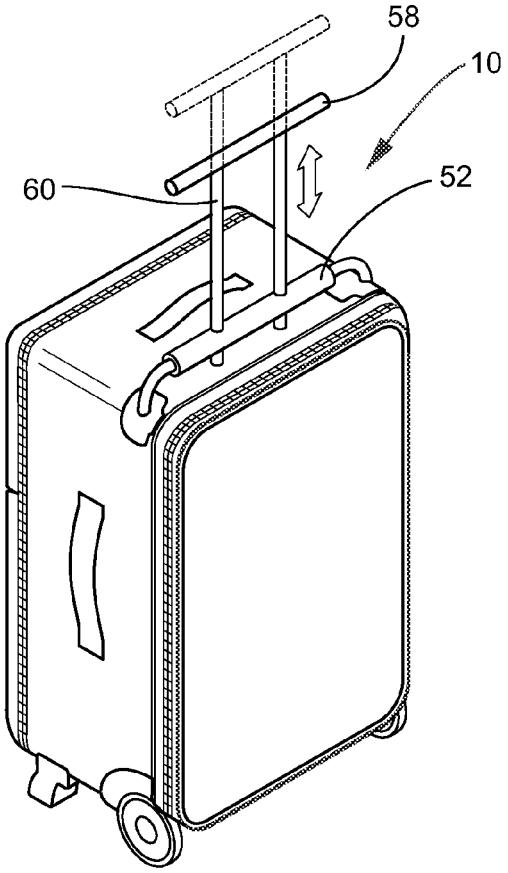
FIG. 10 is a perspective view of the bag showing the pump handle in motion.
Figure 12:
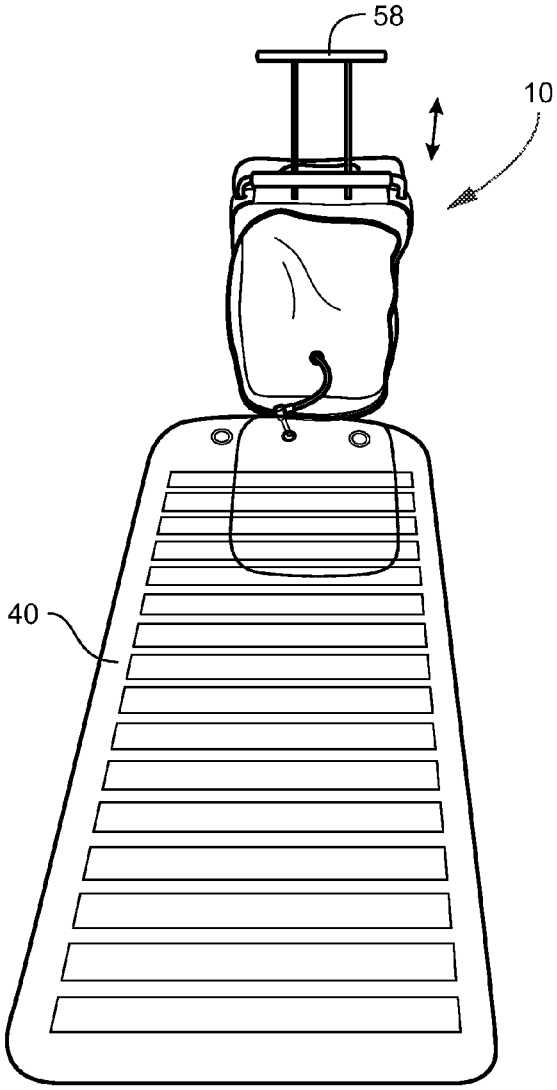
FIG. 12 is a perspective view showing the inflatable device being inflated.
Figure 13:
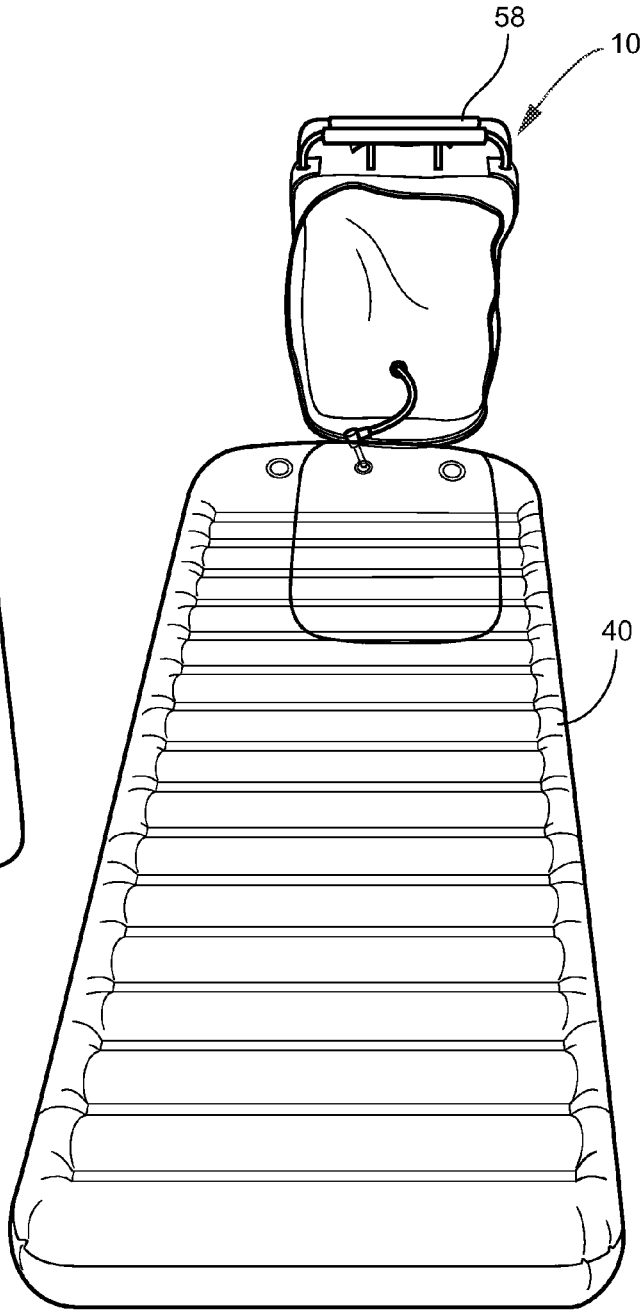
FIG. 13 is a perspective view showing the inflatable device fully inflated.
Figure 14:
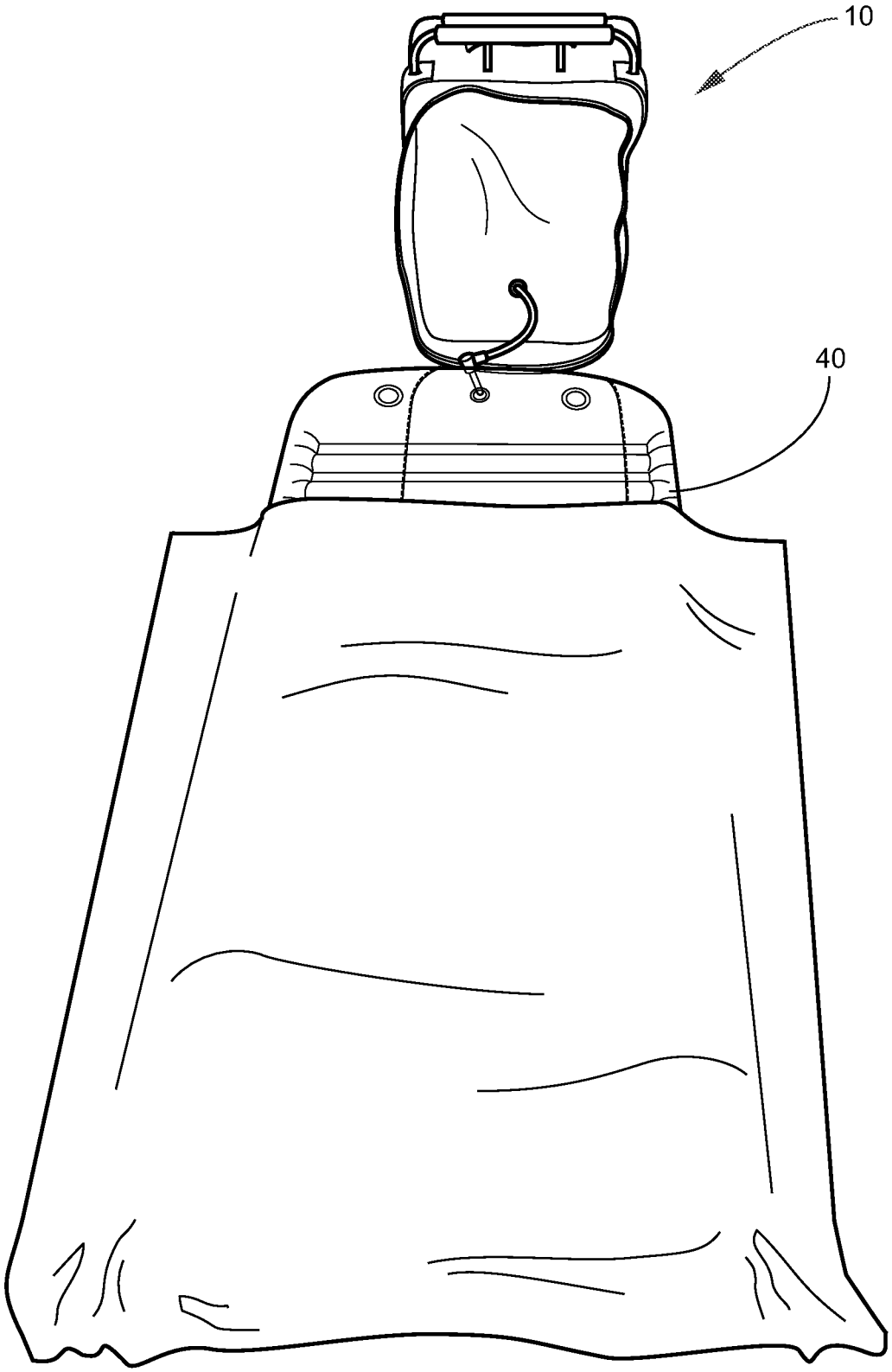
FIG. 14 is perspective view showing the inflatable device ready for use.
Figure 15:
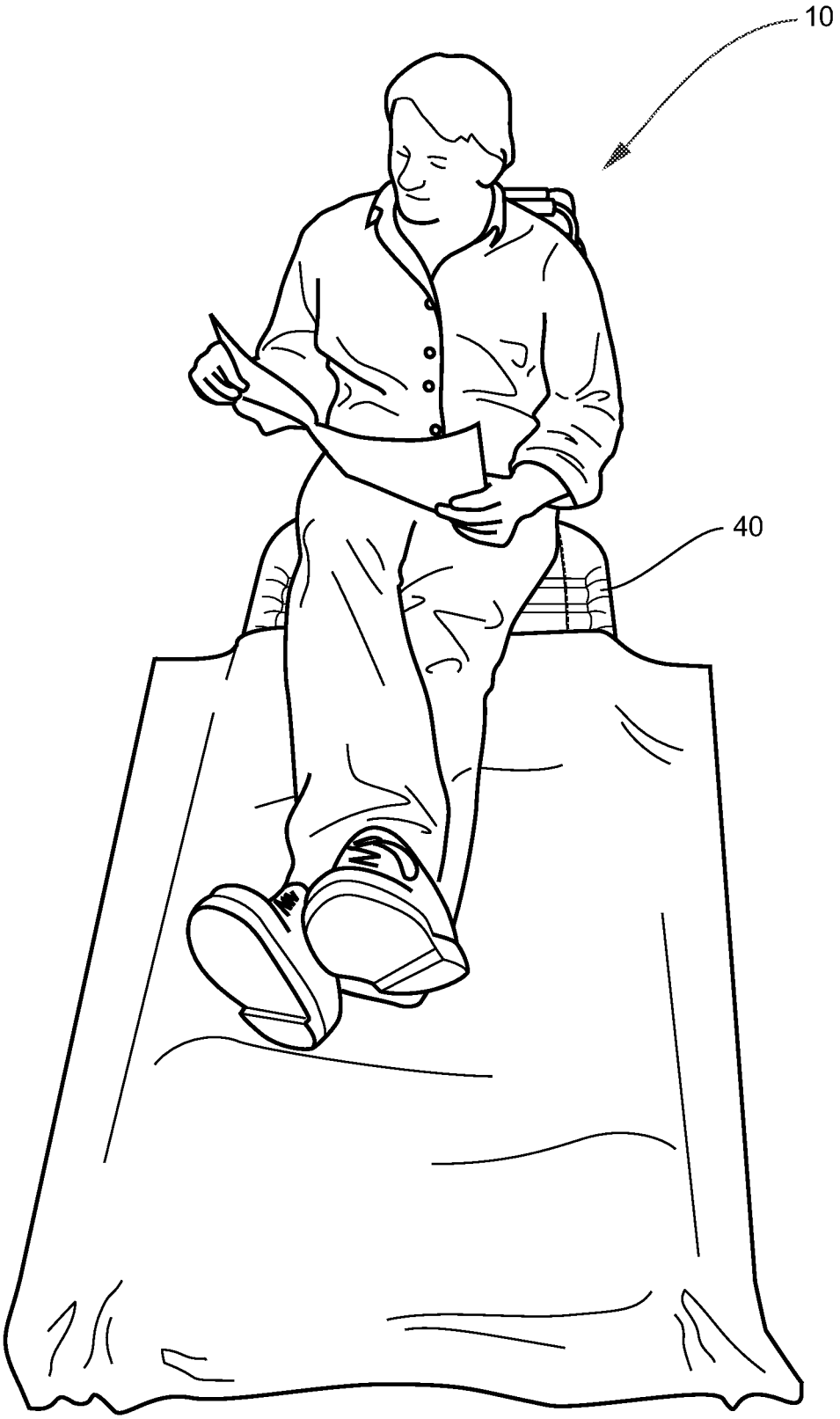
FIG. 15 is a perspective view showing the inflatable device in use.

A piston 72 is disposed within the cylinder 70 and movable in the vertical direction, as shown in FIG. 10. When the cylinder 70 is moved upward in the vertical direction, air fills the cylinder 70, and afterwards, the piston 72 is moved downward in the vertical direction, the air is forced from the cylinder 70 and through the opening in the air chamber 82. The air optionally passes into an air bridge 78 and through the nozzle 76 for inflating the inflatable device 40, as shown in FIGS. 12 and 14. FIGS. 14 and 15 illustrate the inflatable device 40 in the fully inflated position and ready to use.

Figure 11:
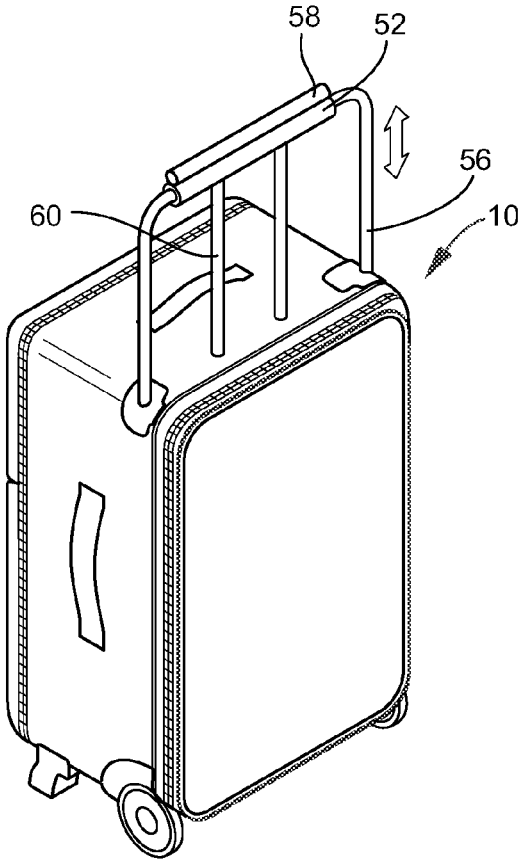
FIG. 11 is a perspective view of the bag showing handle assembly in motion.

As illustrated in FIG. 2, the downwardly extending member 62 of the pump handle 58 serves as the piston 72 of the pump assembly 64. The pump handle 58 is disposed adjacent the horizontal bar 52 of the handle assembly 50 and is movable separate from the horizontal bar 52. Alternatively, the horizontal bar 52 and pump handle 58 may be moved in unison, as shown in FIG. 11.

The first top wall 24 is selectively secured to the first pair of opposed sidewalls 18 and the second pair of opposed sidewalls 20 of the first compartment 12 by an engagement means 86. A second top wall 38 is selectively secured to the first pair of opposed sidewalls 32 and the second pair of opposed sidewalls 34 of the second compartment 26 by an engagement means 86. As illustrated, the engagement means 86 is a zipper. However, the engagement means 86 may be any device that can selectively secure the first top wall 24 to the first pair of opposed sidewalls 18 and the second pair of opposed sidewalls 20 of the first compartment 12 and the second top wall 38 to the first pair of opposed sidewalls 32 and second pair of opposed sidewalls 34 of the second compartment 26, such as a hook and loop fastener, buttons, and the like.

As illustrated, the bag 10 may include at least one pocket 88 disposed on an external side of the first top wall 24. The at least one pocket 88 is selectively sealable by an engagement means, such as a zipper. The bottom side 44 of the bag 10 may contain at least two wheels 88, as illustrated in FIG. 7. The wheels 88 are spaced-apart and disposed in close proximity to the first side 46 and second side 48 of the bag. As illustrated, the bag 10 contains two wheels 88, but it should be noted that the bag 10 may contain four wheels 88 disposed adjacent to each corner of the bottom side 44 of the bag 10. A side handle 90 may be disposed on the external side of the first side 46 and/or second side 48 of the bag 10.

Figure 16:
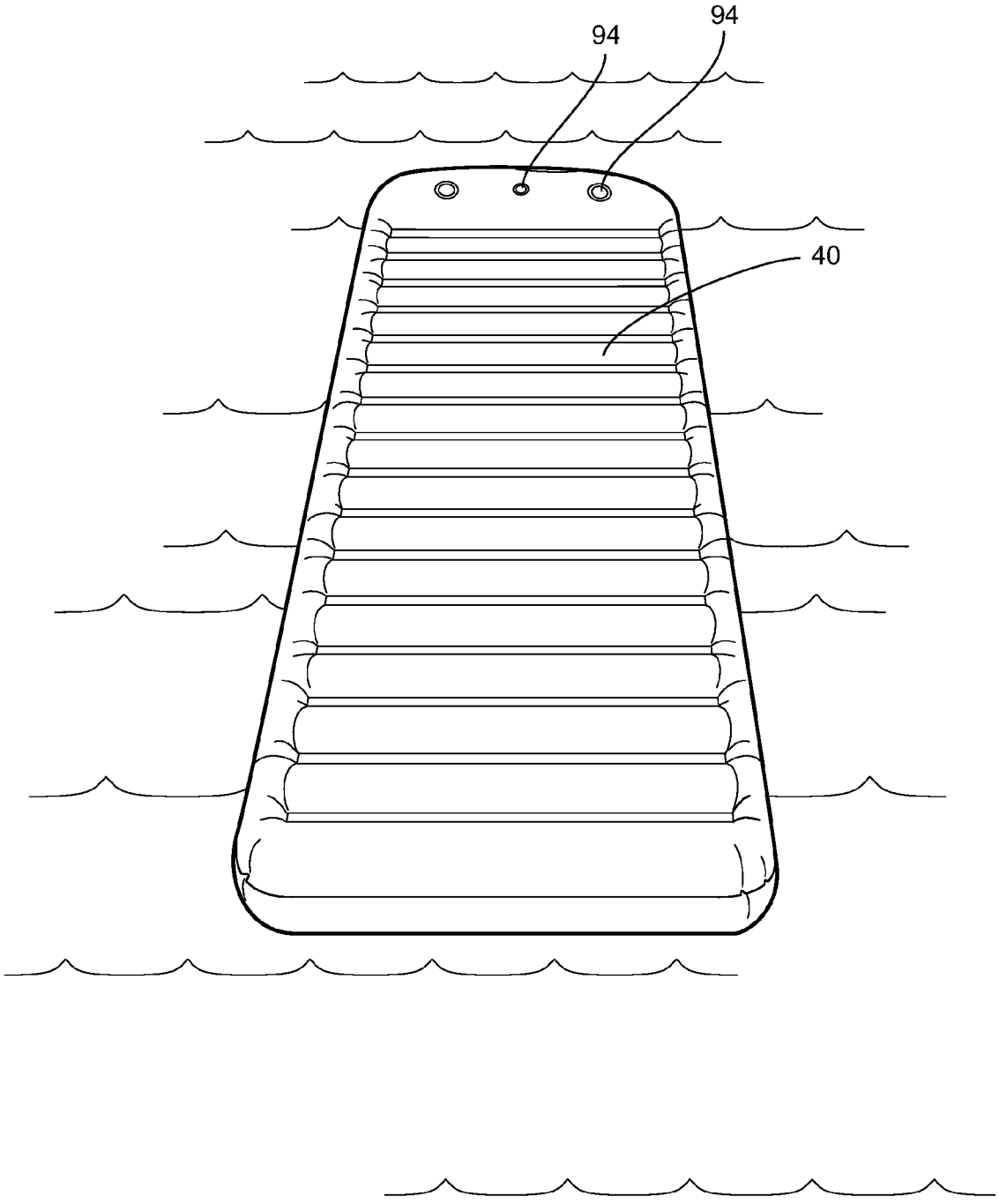
FIG. 16 is a perspective view of the inflatable device in use.

The inflatable device 40 is composed of rubber and foldable. The inflatable device 40 is foldable for storage within the second compartment 26. When stored, the inflatable device 40 is engaged to the nozzle 76, which provides two functions. The first function serves as to releasably retain the inflatable device 40 to the bag. The second function allows the inflatable device to be inflatable by just separating the second top wall 38 from the first pair of opposed side 46 and second pair of opposed sides 48. As illustrated in FIG. 16, the inflatable device 40 may be detached from the bag 10 and serve as a rescue/safety device. The inflatable device 40 contains two openings as shown in FIG. 4. The inflatable device 40 contains a small opening 96 that allows the nozzle 76 to be selectively secured. Alternatively, a user may manually inflate the inflatable device 40 by blowing into the small opening 96. The large opening 98 is designed to allow air to exit the inflatable device 40. An inflation device 40, such as a vacuum configured to blow air outwards, may be inserted into the large opening 98 for inflating the inflation device 40. Alternatively, a user may manually inflate the inflatable device 40 by blowing into the large opening 98. Each opening contains a releasably secured cap 94.

As illustrated in FIG. 7, the bag 10 may contain D-rings 92 affixed to the external side of the bottom side 44 of the bag 10. The D-rings 92 are designed to receive straps that may be releasably attached to the D-rings 92 so that a user may carry the bag 10 on the user's back.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

What is claimed is:

1. A bag, comprising:

a first compartment and a second compartment;

the first compartment having a bottom wall that extends to an outer edge and a first pair and a second pair of opposed sidewalls that extend generally perpendicularly from the outer edge of the bottom wall forming a cavity therein;

a top wall selectively secured to the first pair and the second pair of opposed sidewalls of the first compartment;

an inflatable device; and a first pump assembly and second pump assembly, the first pump assembly and second pump assembly are housed within the first compartment comprising a support base having a top portion and a bottom portion, wherein the top portion is engaged to a cylinder, a piston having a top portion and a bottom portion is disposed within the cylinder, and a handle is positioned on an outer edge of a sidewall is engaged to the top portion of the piston, wherein the piston extends through the bag, and an air bridge connects the first pump assembly to the second pump assembly.

2. The bag of claim 1, further comprising a second compartment for housing the inflatable device.

3. The bag of claim 1, further comprising a pair of wheels disposed on the bag.

4. The bag of claim 1, further comprising a zipper for selectively securing the top wall to the first and the second pair of opposed sidewalls.

5. The bag of claim 1, further comprising a handle disposed on the bag.

6. The bag of claim 1, wherein the first and the second pair of opposed sidewalls are rigid.

7. The bag of claim 1, further comprising an opening in the inflatable device with a releasably secured cap for allowing air to be inserted into the inflatable device.

8. The bag of claim 1, further comprising at least two wheels disposed on the bag.

9. The bag of claim 1, further comprising a telescoping handle.

10. A bag, comprising:

a first compartment and a second compartment;

the first compartment having a bottom wall that extends to an outer edge and a first pair and a second pair of opposed sidewalls that extend generally perpendicularly from the outer edge of the bottom wall forming a cavity therein;

a first top wall selectively secured to the first pair and the second pair of opposed sidewalls of the first compartment;

a second compartment having a bottom wall that extends to an outer edge and a first pair and a second pair of opposed sidewalls that extend generally perpendicularly from the outer edge of the bottom wall forming a cavity therein;

a second top wall selectively secured to the first pair and the second pair of opposed sidewalls of the second compartment;

an inflatable device contained within the second compartment; and a pump assembly housed within the first compartment comprising a first support base having a top portion and a bottom portion and a second support base having a top portion and a bottom portion, wherein the bottom portion of the first support base and the top portion of the first support base is engaged to a first cylinder and the top portion of the second support base is engaged to a second cylinder, a first piston having a top portion and a bottom portion is disposed within the first cylinder and a second piston having a top portion and a bottom portion is disposed within the second cylinder, and a handle is positioned on an outer edge of a sidewall is engaged to the top portion of the first piston and second piston, wherein the first piston and second piston extend through the bag, and an air bridge engaging the first cylinder and the second cylinder connected to a nozzle for expelling air from the first cylinder and the second cylinder.

11. The bag according to claim 10, further comprising at least a pair of wheels.

12. The bag according to claim 10, further comprising at least one support member for providing stability and support for the bag.

* * * * *